US005538136A

United States Patent [19]

Onneweer

[11] Patent Number: 5,538,136

[45] Date of Patent: Jul. 23, 1996

[54] EGG-STORER

[75] Inventor: Frederik J. Onneweer, Tervuren, Belgium

[73] Assignee: Dart Industries Inc., Deerfield, Ill.

[21] Appl. No.: 385,245

[22] Filed: Feb. 7, 1995

[51] Int. Cl.[6] ..... B65D 85/32

[52] U.S. Cl. ..... 206/521.8; 206/508; 206/815

[58] Field of Search ..... 206/508, 521, 206/521.1–521.9, 583, 591–594, 815

[56] References Cited

U.S. PATENT DOCUMENTS

| | | |
|---|---|---|
| D. 95,290 | 4/1935 | Sherman . |
| 1,618,325 | 2/1927 | Chalmers . |
| 1,990,145 | 2/1935 | Swift, Jr. . |
| 2,348,397 | 5/1944 | Lindley, Jr. et al. . |
| 2,636,660 | 4/1953 | Brown . |
| 3,484,035 | 12/1969 | Swett et al. . |
| 3,902,622 | 9/1975 | Emery . |
| 4,005,800 | 2/1977 | Schurman . |
| 4,194,682 | 3/1980 | Congleton et al. . |

FOREIGN PATENT DOCUMENTS

| | | |
|---|---|---|
| WO91/12191 | 8/1991 | WIPO . |

*Primary Examiner*—Jimmy G. Foster
*Attorney, Agent, or Firm*—John A. Doninger

[57] ABSTRACT

An egg storer including a relatively rigid transparent outer box formed of two hinged shells and receiving a pair of removable cushioning inserts. Each insert includes pockets therein which receive and cushion eggs, and suspend the eggs above the bottom wall of the box. The pockets are arranged in two rows of spaced pockets with the rows longitudinally offset and the pockets of adjacent rows generally transversely internested. The overall configuration of the box and internal inserts is an elongate and narrow oblique parallelepiped.

9 Claims, 4 Drawing Sheets

8
12
42
4
8
30
18
10
20
22
36
4
62
68

52
16
72
82
7
32
14
62
48
74
54
26
28
7
36
44
42
26
59
20
52
28
74
24
18

14
16
18
20
22
24
26
30
32
34
36
40
42
44
46
48
50
56
58
59
60
61
62
64
68
70
72
74
86

EGG-STORER

BACKGROUND OF THE INVENTION

Egg containers, generally referred to as egg cartons or boxes, are a well-known means for the transporting and storing of the fragile, thin-shelled foodstuff. Such egg cartons have traditionally been formed of molded paperboard pulp, or more recently an appropriate foamed synthetic resinous material.

Such cartons are relatively soft and intended to provide a cushioned support for the eggs. However, the known cartons at the same time require a substantial degree of care in storing or stacking the cartons for display, in packaging the cartons, as in a grocery bag, and in the general handling of the cartons.

Further, while the known cartons are, because of the inherent degree of flexure therein, able to accommodate eggs of differing sizes, for very large eggs, cartons of a different size are frequently required.

The known cartons commonly include two rows of six pockets each to accommodate a dozen eggs, with the pockets in the two rows being transversely aligned. For variety of reasons consumers have, in recent years, tended to purchase smaller amounts of eggs, normally six rather than the conventional twelve. Such reasons can vary from a desire for less cholesterol in the diet, a lack of appropriate storage space for a full dozen eggs, smaller families, etc. While various forms of the traditional cartons have included perforated lines or similar lines of weakness dividing the twelve-egg carton into two six-egg sections, such lines of weakness tend to inherently weaken the carton itself. More importantly, and as will be appreciated by any shopper, an attempt to split the carton into the two sections can lead to an actual breaking of one or more of the eggs. The split sections will also have a greater inherent weakness than the full carton.

SUMMARY OF THE INVENTION

The egg container of the present invention, while performing the functions of a traditional egg carton, is preferably referred to as an egg storer or carrier in that it provides significant additional advantages in providing a protective environment for eggs as they progress from the initial packaging thereof through use by the consumer.

The egg storer is specifically configured to accommodate six eggs in two offset rows of three eggs each, providing a narrow and relatively short profile particularly adapted for accommodation in refrigerator door shelves.

The new container incorporates other features which are of particular significance with regard to the consumer, including a rigid and positively sealing construction which facilitates the carrying of the container home without excessive padding or packaging. The sealed box also maintains maximum freshness and protection of the eggs from odors of other contents of the refrigerator. In addition, the egg storer or the inserts thereof are particularly adapted for use by the consumer as a means for actually serving cooked eggs at the table. Further, and particularly in light of the rigidity of the container in combination with the cushioned accommodation of the eggs, the container provides a convenient and secure means for carrying and dispensing hard boiled eggs and the like at picnics and other gatherings.

The egg storer of the invention, having egg-receiving formed pockets, is so constructed as to accommodate a wide variety of different egg sizes, including very large eggs which heretofore required specially formed enlarged egg cartons. The rigidity of the egg storer, as well as complementary and interlocking top and bottom surfaces provided thereon, allow for the stacking of the storers on each other in a safe and stable manner.

Structurally, the egg storer, preferably formed of appropriate plastic or synthetic resinous materials, comprising an outer rigid box and two resiliently compressible or cushioning inserts removably received within the box. The box itself is formed of upper and lower shells preferably transparent or translucent and interconnected along adjacent longitudinal edge portions by an integral living hinge. An appropriate snap closing catch or latch is mounted on the longitudinal edge portions opposed from the hinge, with the peripheral edges of the shells engaging each other in a positive manner upon a closing of the shells over each other. The shells are so configured, and the living hinge so positioned, whereby the top shell, when opened, will lie flat and align with the bottom shell to provide, as an example, a serving container for cooked eggs.

The two inserts, preferably colored for visibility through the box, are respectively received within the bottom and top shells. The inserts are configured for easy and convenient grasping by one hand to remove the inserts as a unit, either individually or separately, and with or without the eggs therein. While the inserts include a degree of compressibility for a cushioning of the eggs, they are what might be considered semi-rigid whereby the inserts are shape-sustaining and capable of supporting a full load of eggs when separated from the protective outer box. The bottom insert includes the egg positioning pockets. The upper insert includes cooperating pockets protectively overly the lower pockets and forming chambers therewith retaining the eggs. The nature of the material of the inserts and the shape of the pockets allow for an accommodation of different size eggs. Further, in those instances wherein very large eggs are to be provided in the storer, the top insert can be removed to provide additional space and allow use of the same egg storer without any construction changes or enlargement. The rigid nature of the storer will be retained even with removal of the upper insert, as will the major cushioning effect provided by the lower egg nesting insert.

Other features and advantages of the egg storer will become apparent as the details of the invention are more fully hereinafter set fourth.

DESCRIPTION OF PREFERRED EMBODIMENT

Figure 1:
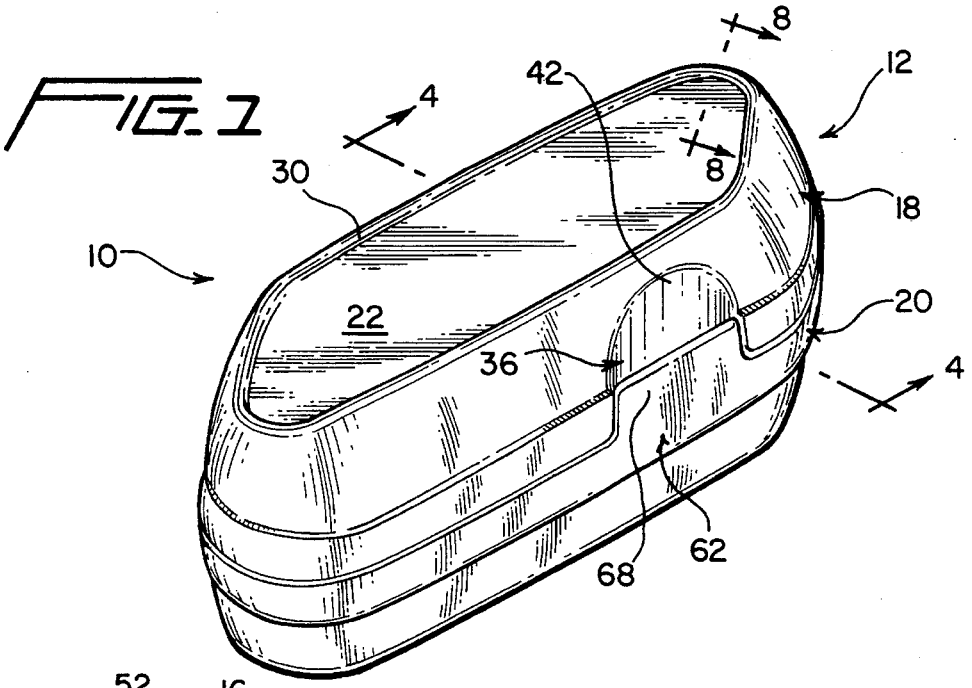
FIG. 1 is a top and front perspective view of the egg storer in a closed position.
Figure 2:
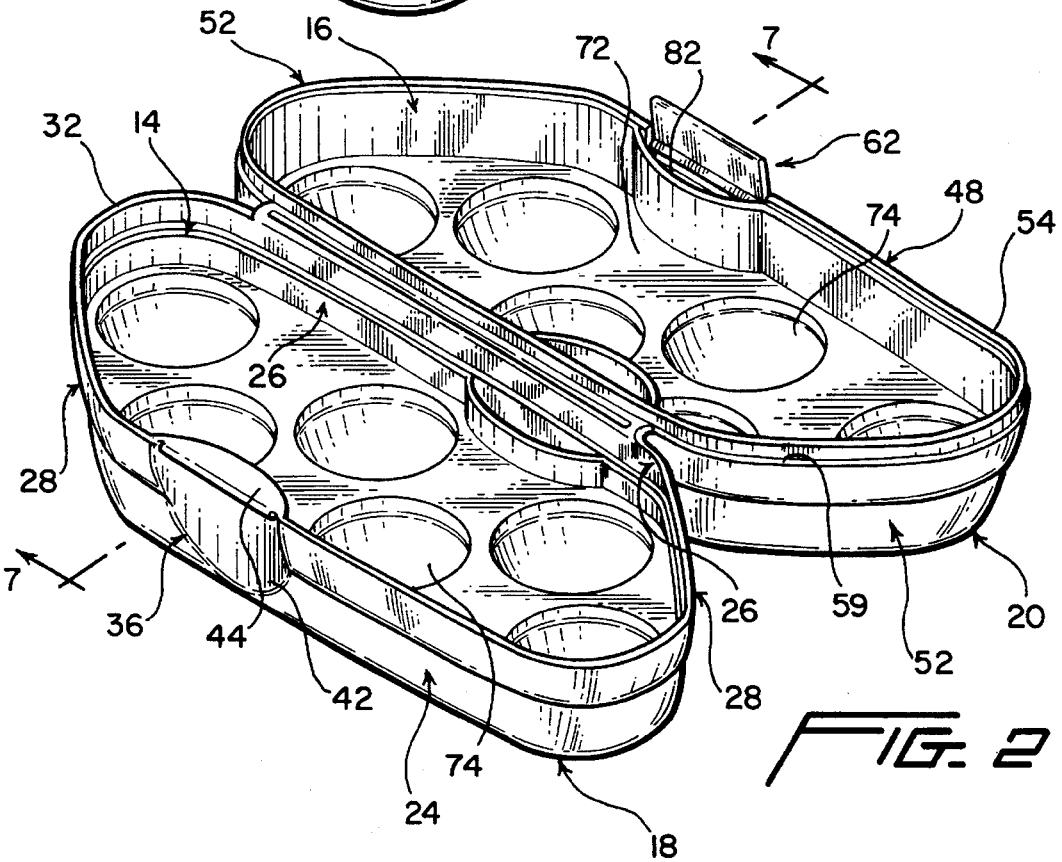
FIG. 2 is a top perspective view of the storer fully open.
Figure 3:
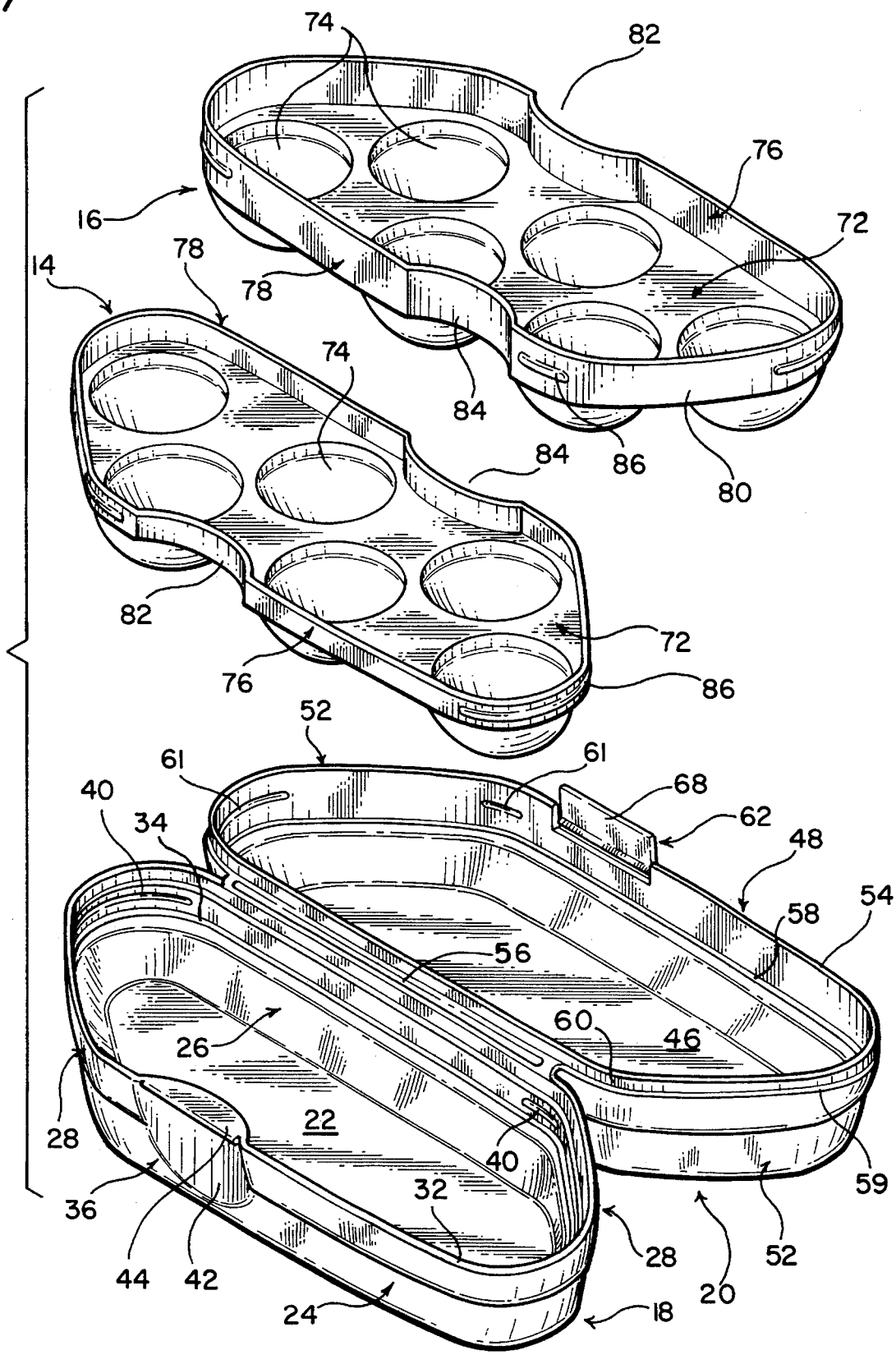
FIG. 3 is an exploded perspective view of the outer box and two inserts which comprise the egg storer.

Referring now more specifically to the drawings, the egg container or storer 10, consists of three components, an outer protective rigid or substantially rigid box 12 and separately formed internal upper and lower cushioning inserts 14 and 16.

The storer 10 is specifically formed to accommodate six eggs in a narrow elongate configuration which can be easily positioned in the door shelves of a standard refrigerator. Pursuant thereto, provision is made for accommodating the eggs in two rows of three eggs each with the rows longitudinally offset from each other and the eggs slightly transversely internested between adjacent eggs of the adjacent row. So positioned, the egg arrangement will define a general oblique-angled parallelogram or rhomboid configuration. The storer 10, closely conforming to the egg arrangement will in turn be of a generally oblique rectangular parallelepiped configuration. Pursuant thereto, the outer protective box 12 has parallel elongate longitudinally offset front and rear faces interconnected by parallel sides angled between the ends of the box faces and joined thereto by rounded corners or transition areas.

The box 12 is formed of an upper shell 18 and a lower shell 20, both of a similar parallelepiped configuration.

The top shell 18 includes a base panel 22 forming a top wall, parallel or substantially parallel front and rear walls 24 and 26 longitudinally offset from each other, and opposed parallel or generally parallel end walls 28 integrally joined at rounded corners or transition areas to the respective ends of the front and rear walls 24 and 26. The walls 24, 26 and 28 are in turn integrally formed with the base panel 22 peripherally thereabout and bow or arc slightly outward from the base panel 22 to define an outwardly opening compartment. The base panel 22, about the outer periphery, has a peripheral projecting seating bead 30.

The peripheral walls 24, 26 and 28 of the upper shell 18, inward from the peripheral outer edge 32 of these walls, are laterally outwardly offset for about one-fourth to one-third of the height of the walls, to define a laterally inward extending support shoulder 34 interrupted only by a latch component 36 integrally formed within the front wall 24. A second sealing shoulder 38, substantially coextensive with the support shoulder 34, is provided about the interior of the upper shell walls 24–28, and positioned in vertically spaced relation to the shoulder 34 at a point approximately one-third of the distance between the outer edge 32 and the shoulder 34, inward from the outer edge 32.

A series of elongate retaining grooves 40 are formed on the inner face or faces of the peripheral walls 24–28 vertically between the shoulders 34 and 38 at selected points about the interior of the upper shell 18, normally at or adjacent to the arcuate corner portions. The latch component 36, in the front wall 24 substantially closer to one end thereof than the other, is formed by arcuately insetting a portion of the front wall 24 to define a finger-access recess 42 with an overlying laterally outwardly directed flange 44 substantially in the plane of the shell outer edge 32. The flange 44 is integral with the wall of the recess 42 to maintain the closed integrity of the box 10.

The lower shell 20 includes a planar base panel 46 forming a bottom wall. Substantially parallel and longitudinally offset front and rear walls 48 and 50 integrally extend from said base panel 46. Integral end walls 52, generally parallel to each other, extend between the corresponding ends of the front and rear walls 48 and 50, with the transition areas or corners between the walls being smoothly arcuate. The walls 48–52, similar to the walls 24–28, arc from the base panel 46 toward the outer peripheral edge 54 of the lower shell 20 and define an outwardly opening compartment.

The rear walls 26 and 50 of the two shells are integrally joined along the outer edge portions thereof by a living hinge 56 for a selective closing of one shell over the other.

The lower shell walls 48–52 are laterally outwardly offset for approximately one-third to two-fifths of the height of the walls inward from the outer edge 54 thereof to define a laterally inwardly directed support shoulder 58. The inner face or faces of the peripheral walls 48–52 above shoulder 58 are generally uninterrupted, except for elongate retaining grooves 61 similar to grooves 40, and terminate in the outer edge 54. The outer face or faces of the lower shell walls 48–52 above shoulder 58 have a peripherally extending laterally outwardly directed sealing shoulder 59 forming a flange portion 60 which is of approximately the same height as the vertical height between the sealing shoulder 38 and outer edge 32 of the upper shell for a stepped nesting of the shells as will be best appreciated from FIGS. 6 and 8. Further, as will be best appreciated from the several cross-sectional views, the living hinge 56 is actually integral with the upper shell 18 at outer edge 32, and with the lower shell 20 at shoulder 59.

A second latch component 62 is integrally formed at least partially within the front wall 48 of the lower shell 20 toward one end of the front wall 48 in transverse alignment with the first latch component 36. The latch component 62 at or slightly below the level of the outer edge 54, is provided with a laterally inwardly directed groove 64 formed to define a small tapered lip 66 immediately thereabove. Upon a closing of the upper shell 18 over the lower shell 20, the outer edge of the flange 44 of the latch component 36 engages the tapered lip 66, causing a slight outward biasing of the lip and adjacent portions of the latch component 62 for a snap-locking of the lateral outer edge of the flange 44 within the groove 64. The undersurface of the lip 66 is so formed as to preclude an upward withdrawal of the latch flange 44 unless the latch component 62 is manually outwardly flexed. In order to facilitate such flexure, and the corresponding opening of the box 12, the latch component 62 includes a vertically projecting finger-engaging manipulating flap 68 integral with the lower shell front wall 48. The latch flap 68 is relatively thinner than the front wall, or at least that portion of the front wall above the support shoulder 58 to allow for unencumbered movement of the lateral outer edge of the flange 44 downward into engagement with the retaining lip 66 immediately above the receiving groove 64. It is to be appreciated that while the outer box 12 is referred to as rigid or substantially rigid, the latch component 62 in particular has a degree of flexible resiliency sufficient to enable a latching and unlatching of the latch assembly as described. With the latch components 36 and 62 engaged, the shells will be in generally sealed relation to each other to prevent contamination of the eggs by airborne odors and the like.

Figure 4:
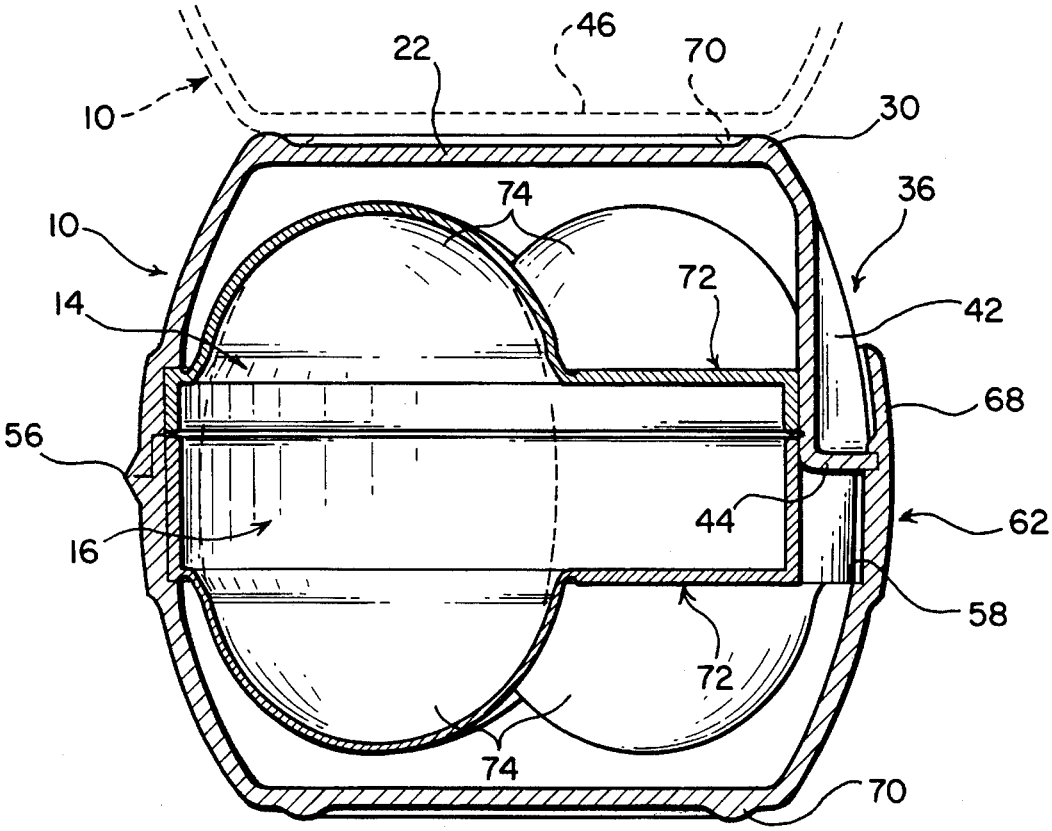
FIG. 4 is an enlarged transverse cross-sectional view taken substantially on a plane passing along line 4—4 in FIG. 1.

The bottom or base panel 46 of the lower shell is provided with a continuous depending support bead 70 sufficiently inward of the peripheral edge of the panel 46 as to, upon a stacking of the closed boxes as suggested in FIG. 4, lie immediately inward of the projecting peripheral bead 30 on the upper shell panel 22. In this manner, the beads not only provide stable support edges for the box 10, both opened and closed, but also provide an interlock for stacked boxes which will prevent lateral shifting or misalignment of the boxes. Noting FIG. 7, it will be seen that the opened shells position the respective panels 22 and 46 in a common plane for support on a horizontal surface, normally a table or counter top. It will also be recognized that the height of the walls of the upper shell is substantially equal to the height of the walls of the lower shell from base panel 46 to the sealing shoulder 59 thereon.

Figures 6, 7, 8:
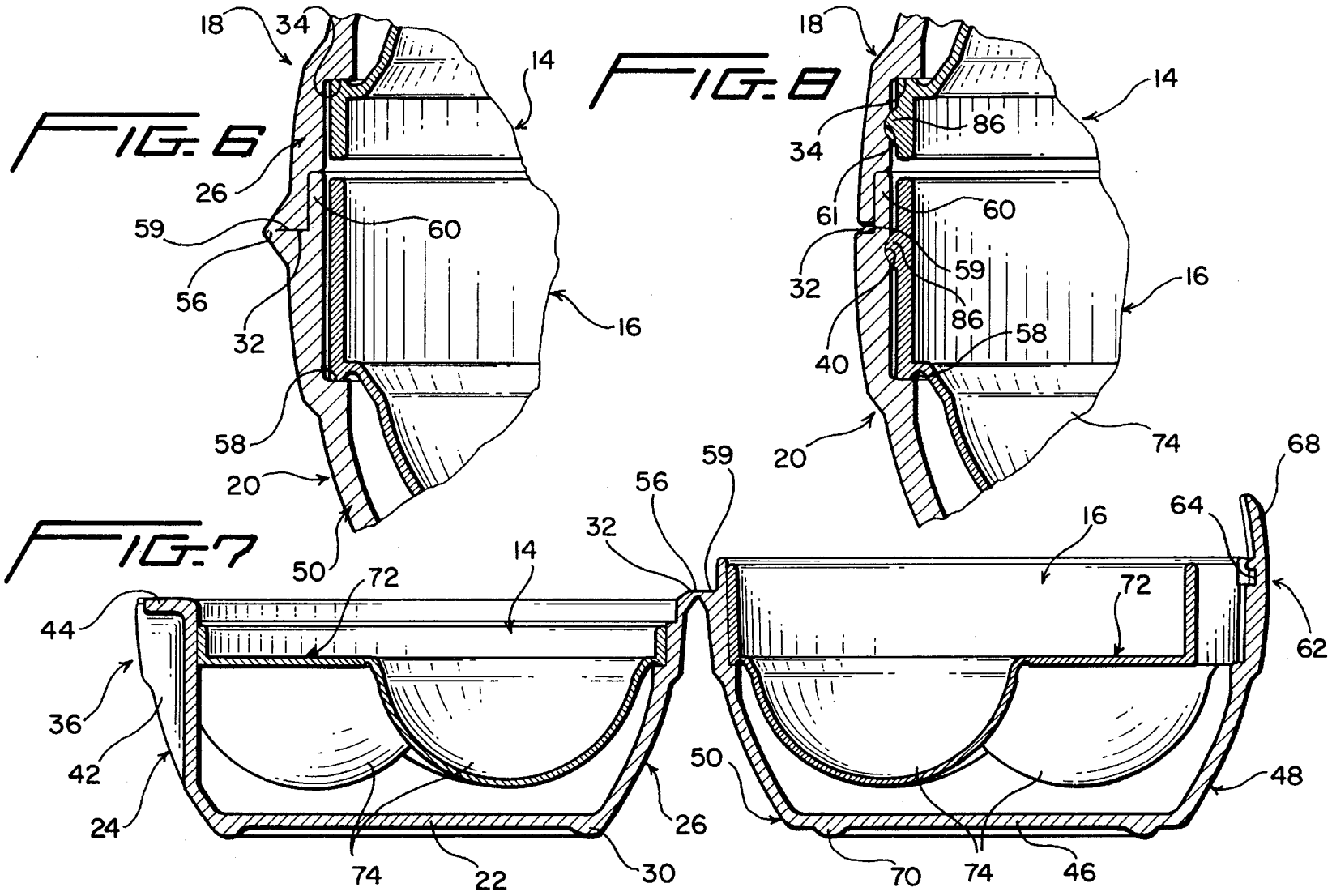
FIG. 6 is an enlarged sectional detail at the living hinge area of the egg storer.
FIG. 7 is an enlarged transverse cross-sectional view taken through the opened egg storer substantially on a plane passing along line 7—7 in FIG. 2.
FIG. 8 is an enlarged cross-sectional detail taken substantially on a plane passing along line 8—8 in FIG. 1.

The upper and lower inserts 14 and 16, formed or molded of an appropriate shape-sustaining cushioning material, are substantial duplicates other than for the greater height of the insert 16. Each of the inserts 14, 16 includes a planar panel 72 with opposed inner and outer faces, and six integral egg-receiving pockets 74 laterally projecting from said inner face. Each of the pockets opens through the insert panel and outer face of the corresponding insert panel, and is of a generally semi-spherical configuration to substantially conform to and accommodate, in a cushioning manner, eggs of varying sizes. The two inserts include opposed parallel front and rear walls 76 and 78, and opposed side walls 80 integral with the peripheral edges of the panels 72 and with each other at arcuately defined corner portions. Each insert 14 and 16 is of a generally oblique rectangular parallelepiped configuration adapted to be closely received within the respective box shells 18 and 20. The peripheral edges of the inserts, at the peripheral outer edges of the base panels 72, are supported directly on the support ledges or shoulders 34 and 58 of the upper and lower shells 18 and 20. The depth of the egg pockets 74, noting FIGS. 4 and 7, is less than the height of the respective shell walls from the respective support shoulders 34 and 58 inward to the respective base panels 22 and 46. Thus, the received eggs will in effect be suspended out of contact with the outer rigid box 12. The egg-receiving pockets 74 are arranged in two longitudinally offset rows with the pockets of each row being spaced and transversely internesting with the pockets of the other row to achieve a compact narrow configuration.

The front and rear insert walls 76 and 78 of each insert include a pair of recesses 82 and 84 defined therein. These recesses are positioned to correspond with the positions of the latch components 36 and 62 upon reception of the inserts within the box shells. The front wall recesses 82 generally conform in shape to the inwardly extending arcuate configuration of the latch component recess 42 for accommodation thereof. The recesses 84 in the rear walls 78, duplicate the recesses 82 whereby each insert can be positioned within the corresponding shell even if turned end for end. It will also be noted that the egg pockets 74 are similarly arranged to accommodate end-for-end rotation, thereby facilitating assembly. The recesses 84 normally associated with the rear walls 78, provide, in the opened box, ready access for insertion of a finger below the insert to facilitate removal of the insert with or without eggs therein. In the opened box, in the lower shell 20, both recesses 82 and 84 are accessible whereby a hand spanning the insert 16 can easily engage both edges of the insert. The offset relationship of the recesses, for a handling of the inserts both in and out of the box shells is particularly desirable as one hand can engage the insert at longitudinally spaced points to best support the load within the relatively soft inserts. It will also be noted that the recesses are conveniently positioned between spaced adjacent egg pockets in each row and are substantially transversely aligned with corresponding pockets in the other row, thereby not interfering with the pocket arrangement and being easily accommodated within the basic configuration of the parallelepiped inserts.

Figure 5:
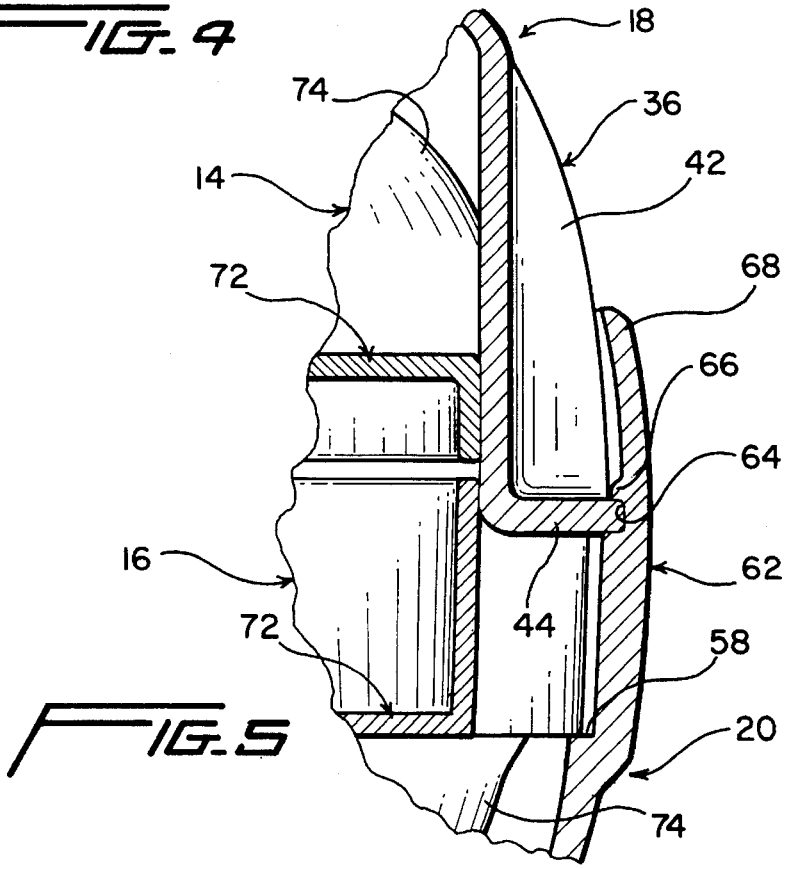
FIG. 5 is an enlarged detail of the latch area of the egg storer.

Noting FIGS. 4–6, in the closed storer or container, the outer peripheral edges of the walls of the upper and lower inserts 14 and 16 are slightly spaced from each other, thus insuring a proper sealed closing and latching of the box shells 18 and 20. In order to facilitate insertion of the inserts within the respective shells, the outer faces or surfaces of the insert walls may be slightly inwardly tapered or mitered from the respective outer edges thereof for non-binding engagement with the surrounding shell walls as the inserts are positioned. Once inserted, it is desirable to retain the inserts in position until specific removal thereof is required. Accordingly, each of the inserts 14 and 16 includes a series of elongate lugs 86 integral with and projecting from the outer surfaces of the insert walls, particularly at or adjacent the corner portions thereof, and vertically positioned to releasably snap-lock within the corresponding grooves 40, 61 defined in the inner surfaces of the shell walls. This particular relationship will be noted in FIG. 8.

The provision of separate inserts adapted to overly each other in the closed carton with the cooperating aligned pockets in each being generally freely suspended between the peripheral edges of the inserts, allow for an accommodation of a wide range of different size eggs. The inserts, within limits, will flex to accommodate the eggs. Should the eggs be of a very large size, the egg storer can be assembled without the upper insert 14, thereby greatly increasing the interior space within which the eggs can be accommodated, while still retained in a cushioning support base.

The foregoing is illustrative of the principals of the invention. It is to be appreciated that the claims hereinafter, are intended to encompass all modifications and equivalent constructions incorporating the inventive features of the invention.

I claim:

1. An egg storage container comprising a substantially rigid outer box and a pair of cushioning inserts; said box including upper and lower shells, each shell having a generally planar base panel with an outer periphery, a pair of rear walls, one extending laterally from each base panel at the periphery thereof, hinge means joining said rear walls outward of the respective base panels for movement of said shells relative to each other between an opened position and a closed position, each shell having a front wall generally paralleling the corresponding rear wall, and end walls interconnecting said front and rear walls, said shell walls defining an outwardly opening compartment in each shell; each of said inserts being removably received within a separate one of said shells and comprising a generally planar panel with a peripheral edge conforming to the corresponding shell walls; said walls of each shell including support means in spaced relation to the corresponding base panel for support of the received insert; each insert panel having opposed inner and outer faces, a plurality of egg-receiving pockets projecting laterally from said inner face of each insert panel and opening through the corresponding insert panel and the outer face thereof, said inner faces facing toward the corresponding shell base panels with said insert pockets being in spaced relation to said base panels, said pockets in each insert, in said closed position of said shells, opening directly toward corresponding ones of said pockets in the other insert and defining egg-receiving chambers therewith, means for releasably retaining said inserts in said shells in both the opened and closed positions thereof, each of said inserts including peripheral walls extending laterally from the outer face thereof, said insert walls lying closely adjacent the walls of the corresponding shell and providing a cushioning layer about said walls, said front and rear walls of each shell being longitudinally offset from each other, said pockets in each insert being arranged in two rows of three pockets each with the pockets in each row being longitudinally offset from the corresponding pockets in the adjacent row and partially received between the pockets in the adjacent row whereby a transverse width of less than two pockets is achieved.

2. The egg storage container of claim 1 wherein said means for retaining said inserts comprises inwardly directed grooves defined in said shell walls, and corresponding lugs extending from said insert walls for snap-locking into said grooves and for manual release therefrom.

3. The egg storage container of claim 1 including finger-receiving recesses at spaced points about the peripheral walls of each insert for manual grasping and handling of said inserts.

4. The egg storage container of claim 1 wherein said shells each contain a substantially continuous stepped outer edge on the walls thereof, said stepped outer edge of each shell internesting with the corresponding stepped outer edge of the other shell whereby a sealed relationship is obtained between said shells in said closed position.

5. The egg storage container of claim 1 including complementary first and second latch components, one on each of said shell front walls, said first latch component comprising a laterally outwardly projecting flange, said second latch component including a laterally inwardly directed groove selectively receiving said flange, said latch components incorporating an inherent degree of resilient flexibility for accommodating latching and release movement of said latch components, said front wall having said first latch component thereon being laterally inwardly recessed adjacent said flange for finger access to said second latch component when engaged with said first latch component.

6. The egg storage container of claim 1 wherein each insert includes a pair of spaced finger-receiving recesses in the peripheral walls thereof, one of said recesses being laterally outward of each pocket row and between adjacent pockets in the corresponding row.

7. An egg storer comprising a substantially rigid outer box and a pair of cushioning inserts; said box including upper and lower shells, each shell having a generally planar base panel with an outer periphery, a pair of substantially coextensive rear walls, one extending laterally from the periphery of the base panel of each shell, said rear walls, laterally outward of the respective base panels, being joined by a living hinge, each shell having a front wall generally paralleling the corresponding rear wall and being longitudinally offset therefrom, and end walls interconnecting said front and rear walls, said walls of each shell defining a parallelepiped configuration; each of said inserts being removably received within a separate one of said shells, each insert comprising a generally planar panel with a peripheral edge generally corresponding to the corresponding shell walls; said walls of each shell having inwardly directed support shoulder means in spaced relation to the base panel of the shell for reception of the peripheral edge of the corresponding insert panel thereon wherein said insert is supported in spaced relation to the corresponding shell base panel; each insert panel having opposed inner and outer faces, a plurality of egg-receiving pockets projecting laterally from said inner face of each insert panel and opening through said outer faces, said inner faces facing toward the corresponding shell base panels, said box having an opened position and a closed position, said shells, in said closed position, having corresponding pockets in said inserts transversely aligned with each other and defining egg-receiving chambers, said pockets being in spaced relation relative to said shell base panels to preclude direct contact of said pockets and base panels, means for releasably retaining said inserts in said shells, each insert including peripheral walls extending laterally from the outer face of the insert panel thereof, said insert walls lying closely adjacent the walls of the corresponding shell and providing a cushioning layer about said walls, said means for retaining said inserts comprising grooves defined in said shell walls, and corresponding lugs extending from said insert walls for snaplocking into said grooves and for manual release therefrom, said walls of each insert including opposed generally parallel elongate front and rear insert walls, said front and rear walls of each insert being longitudinally offset from each other, and finger-accommodating recesses, one in each of said elongate front and rear walls of each insert in longitudinally offset relation to each other.

8. An egg storer comprising a substantially rigid outer box and a pair of cushioning inserts; said box including upper and lower shells, each shell having a generally planar base panel with an outer periphery, a pair of substantially coextensive rear walls, one extending laterally from the periphery of the base panel of each shall, said rear walls, laterally outward of the respective base panels, being joined by a living hinge, each shell having a front wall generally paralleling the corresponding rear wall and being longitudinally offset therefrom, and end walls interconnecting said front and rear walls, said walls of each shell defining a parallelepiped configuration; each of said inserts being removably received within a separate one of said shells, each insert comprising a generally planar panel with a peripheral edge generally corresponding to the corresponding shell walls; said walls of each shell having inwardly directed support shoulder means in spaced relation to the base panel of the shell for reception of the peripheral edge of the corresponding insert panel thereon wherein said insert is supported in spaced relation to the corresponding shell base panel; each insert panel having opposed inner and outer faces, a plurality of egg-receiving pockets projecting laterally from said inner face of each insert panel and opening through said outer faces, said inner faces facing toward the corresponding shell base panels, said box having an opened position and a closed position, said shells, in said closed position, having corresponding pockets in said inserts transversely aligned with each other and defining egg-receiving chambers, said pockets being in spaced relation relative to said shell base panels to preclude direct contact of said pockets and base panels, said pockets of each insert being arranged in two rows of three pockets each, said pockets in each row being longitudinally offset from the corresponding pockets in the adjacent row of the same insert, each insert including peripheral walls extending from the outer face of the insert panel thereof, said walls of each insert including opposed generally parallel elongate front and rear insert walls, said front and rear walls of each insert being longitudinally offset from each other, and finger-accommodating recesses, one in each of said elongate front and rear walls of each insert in longitudinally offset relation to each other, each of said recesses of each insert being positioned between an adjacent pair of pockets.

9. An egg storer comprising a substantially rigid outer box and at least one cushioning insert; said box including upper and lower shells, each shell including a base panel having an outer periphery, a pair of rear walls, one extending from each of the base panels of the upper and lower shells, hinge means joining said rear walls in spaced relation from said base panels for movement of said shells between an opened position and a closed position, each shell having a front wall generally paralleling the corresponding rear wall, and end walls interconnecting said front and rear walls, said walls defining an outwardly opening compartment in each shell; said at least one insert being removably received within said lower shell, said at least one insert comprising a generally planar panel with a periphery corresponding to the lower shell, said walls of said lower shell having support means in spaced relation to the base panel thereof for support of said at least one insert, said panel of said at least one insert having opposed inner and outer faces, a plurality of egg-receiving pockets projecting laterally from said inner face and opening through said outer face, said inner face being directed toward and spaced from the base panel of said lower shell, said front and rear walls of said shells being longitudinally offset from each other and defining, with said end walls, a parallelepiped configuration, said at least one insert being of similar configuration with said pockets arranged in two rows, said pockets, in each row, being longitudinally offset from the pockets in the adjacent row and partially nested between the pockets of the adjacent row, said at least one insert including front and rear walls extending from the outer face thereof, said walls lying closely adjacent the corresponding walls of said lower shell, and finger-accommodating recesses, one in each of said elongate front and rear walls of said at least one insert in longitudinally offset relation to each other, each of said recesses being positioned between an adjacent pair of pockets.

* * * * *